US006863134B2

(12) United States Patent
Seith et al.

(10) Patent No.: US 6,863,134 B2
(45) Date of Patent: Mar. 8, 2005

(54) ROTARY TOOL

(75) Inventors: Warren A. Seith, Bethlehem, PA (US); Louis J. Colangelo, III, Bethlehem, PA (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 10/384,447

(22) Filed: Mar. 7, 2003

(65) Prior Publication Data

US 2004/0173364 A1 Sep. 9, 2004

(51) Int. Cl.[7] ..... B25D 15/00

(52) U.S. Cl. ..... 173/1; 173/93.6; 173/114; 173/205

(58) Field of Search ..... 173/1, 93, 93.6, 173/94, 109, 114, 203, 205, 206, 138, 128

(56) References Cited

U.S. PATENT DOCUMENTS

| | | | | |
|---|---|---|---|---|
| 1,042,094 A | | 10/1912 | Demmler | |
| 1,045,956 A | | 12/1912 | Demmler | |
| 2,580,607 A | | 1/1952 | Schmid | |
| 2,591,323 A | | 4/1952 | Webb | |
| 2,637,426 A | * | 5/1953 | Sittert | 173/93.6 |
| 2,720,956 A | | 10/1955 | Coombes | |
| 2,747,447 A | | 5/1956 | Burleigh | |
| 2,801,718 A | | 8/1957 | Kaman | |
| 2,814,277 A | | 11/1957 | Jimerson | |
| 2,842,994 A | | 7/1958 | Stine | |
| 2,850,128 A | | 9/1958 | Sittert | |
| 2,863,539 A | | 12/1958 | Yeager | |
| 2,947,283 A | | 8/1960 | Roggenburk | |
| 3,053,360 A | | 9/1962 | Madsen | |
| 3,116,617 A | | 1/1964 | Skoog | |
| 3,123,156 A | * | 3/1964 | Gapstur | 173/48 |
| 3,174,559 A | | 3/1965 | Vaughn | |
| 3,195,702 A | | 7/1965 | Alexander | |
| 3,212,295 A | | 10/1965 | Vaughn | |
| 3,226,858 A | | 1/1966 | Spannhake | |

(List continued on next page.)

OTHER PUBLICATIONS

Ingersoll–Rand Company, Equi–Pulse Nutrunner Product Description, Air Tool Manual, Apr. 1990, pp. 46 and 47, U.S.A.

Ingersoll–Rand Company, Tool and Hoist Division, Professional Tools Catalog, Power–Pulse Plus Nutrunners, Liberty Corner, NJ, 1997, U.S.A.

*Primary Examiner*—Eugene Kim
*Assistant Examiner*—Paul Durand
(74) *Attorney, Agent, or Firm*—Michael Best & Friedrich LLP

(57) ABSTRACT

A rotary tool, such as an impact wrench, includes a housing having a forward end and supporting a motor. The motor has a motor shaft extending axially through the housing and defining an axis. The rotary tool further includes a frame coupled to the motor shaft and rotatable relative to the housing about the axis in response to rotation of the motor shaft. The frame defines an interior space. The rotary tool also includes a piston supported by the frame and moveable axially in the interior space and an output shaft supported in the forward end of the housing and rotatable about the axis. The output shaft has a plurality of cams. The piston is engageable with the plurality of cams to intermittently hammer the output shaft.

19 Claims, 12 Drawing Sheets

U.S. PATENT DOCUMENTS

| | | | | | |
|---|---|---|---|---|---|
| 3,253,662 | A | | 5/1966 | Sacchini | |
| 3,254,571 | A | | 6/1966 | Kuhn | |
| 3,319,723 | A | | 5/1967 | Kramer | |
| 3,323,395 | A | | 6/1967 | Burnett et al. | |
| 3,414,066 | A | * | 12/1968 | Wallace | 173/93.6 |
| 3,428,137 | A | * | 2/1969 | Schaedler et al. | 173/93.6 |
| 3,468,222 | A | | 9/1969 | Cordes et al. | |
| 3,491,839 | A | | 1/1970 | McIntire | |
| 3,668,976 | A | | 6/1972 | Hieber et al. | |
| 3,908,768 | A | * | 9/1975 | Hess | 173/93 |
| 4,149,602 | A | | 4/1979 | James | |
| 4,368,784 | A | * | 1/1983 | Wunsch et al. | 173/176 |
| 4,375,181 | A | | 3/1983 | Conway | |
| 4,381,236 | A | | 4/1983 | Cox | |
| 4,557,337 | A | * | 12/1985 | Shibata | 173/93.5 |
| 4,658,913 | A | | 4/1987 | Yantsen et al. | |
| 4,735,595 | A | | 4/1988 | Schoeps | |
| 4,817,736 | A | * | 4/1989 | Ono | 173/93 |
| 4,867,250 | A | | 9/1989 | Ono | |
| 5,012,709 | A | | 5/1991 | Su | |
| 5,042,592 | A | * | 8/1991 | Fisher | 173/109 |
| 5,083,619 | A | | 1/1992 | Giardino et al. | |
| 5,249,502 | A | | 10/1993 | Radocaj | |
| 5,341,723 | A | | 8/1994 | Hung | |
| 5,542,646 | A | | 8/1996 | Bunyan | |
| 5,544,710 | A | | 8/1996 | Groshans et al. | |
| 5,673,759 | A | | 10/1997 | Biek | |
| 5,711,380 | A | * | 1/1998 | Chen | 173/48 |
| 5,992,538 | A | * | 11/1999 | Marcengill et al. | 173/93 |
| 6,047,779 | A | * | 4/2000 | Wallace | 173/93.5 |
| 6,223,834 | B1 | * | 5/2001 | Takamura et al. | 173/93.5 |
| 6,491,111 | B1 | | 12/2002 | Livingston et al. | |

* cited by examiner

ROTARY TOOL

FIELD OF THE INVENTION

The present invention relates to rotary tools and, more particularly, to a drive system for a rotary tool.

BACKGROUND OF THE INVENTION

A rotary tool, such as an impact wrench, generally includes a housing supporting a motor, a drive mechanism driven by the motor, an output shaft having a first end adapted to engage a fastener and a second end adapted to engage the drive mechanism. In impact wrenches, the drive mechanism generally includes a hammer member, which periodically impacts the output shaft, rotating the output shaft about a central axis to hammer or drive fasteners into or remove fasteners from a work piece.

SUMMARY OF THE INVENTION

The present invention provides a rotary tool, such as an impact wrench. In one construction, the rotary tool includes a housing having a forward end and supporting a motor. The motor has a motor shaft extending axially through the housing and defining an axis. A frame is coupled to the motor shaft and is rotatable relative to the housing about the axis in response to rotation of the motor shaft. The frame defines an interior space. A piston is supported by the frame and is moveable axially in the interior space. An output shaft is supported in the forward end of the housing and is rotatable about the axis. The output shaft has a plurality of cams. The piston is engageable with the plurality of cams to intermittently deliver torque impulses to the output shaft.

In another construction, the output shaft includes a rearward surface and the plurality of cams extend axially from the rearward surface. The piston includes an axially extending portion and the output shaft defines an aperture. The axially extending portion is receiveable in the aperture.

In yet another construction, the frame defines an axially extending groove and the piston includes a plurality of radially extending arms. The plurality of radially extending arms are engageable in the axially extending groove to transfer rotational motion from the frame to the piston.

In still another construction, the rotary tool includes a housing having a forward end and supporting a motor. The motor has a motor shaft extending axially through the housing and defining an axis. A frame is coupled to the motor shaft and is rotatable relative to the housing about the axis in response to rotation of the motor shaft. The frame has a first end and a second end and defines an interior space between the first end and the second end. A piston is supported in the frame and is moveable axially in the interior space between a retracted position, in which the piston is adjacent the second end, and an extended position, in which the piston is spaced a distance from the second end. An output shaft is supported in the forward end of the housing and is rotatable about the axis. The piston is engageable with the output shaft to deliver torque impulses to the output shaft about the axis when the piston is in the extended position.

In another construction, the rotary tool includes a housing having a forward end and supporting a motor. The motor has a motor shaft extending axially through the housing and defining an axis. A frame is coupled to the motor shaft and is rotatable relative to the housing about the axis in response to rotation of the motor shaft. The frame defines an internal space. A piston is supported in the internal space for rotation with the frame about the axis. An output shaft is supported in the forward end of the housing and is rotatable about the axis. One of the output shaft and the piston has a protrusion. Another of the output shaft and the piston has a contoured recess. The protrusion is engageable in the recess to rotatably couple the output shaft and the piston. The protrusion cammingly engages the contoured recess to reciprocate the piston along the axis.

The present invention also provides a method of operating the rotary tool.

Other features and advantages of the invention will become apparent to those skilled in the art upon review of the following detailed description, claims, and drawings.

BRIEF DESCRIPTION OF THE DRAWINGS

The present invention is further described with reference to the accompanying drawings, which show constructions of the present invention. However, it should be noted that the invention as disclosed in the accompanying drawings is illustrated by way of example only. The various elements and combinations of elements described below and illustrated in the drawings can be arranged and organized differently to result in constructions which are still within the spirit and scope of the present invention.

In the drawings, wherein like reference numerals indicate like parts.

DETAILED DESCRIPTION

As used herein and in the appended claims, the terms "upper", "lower", "first", "second", "third", "forward", and "rearward" are used herein for description only and are not intended to imply any particular orientation, order, or importance.

Figure 1:
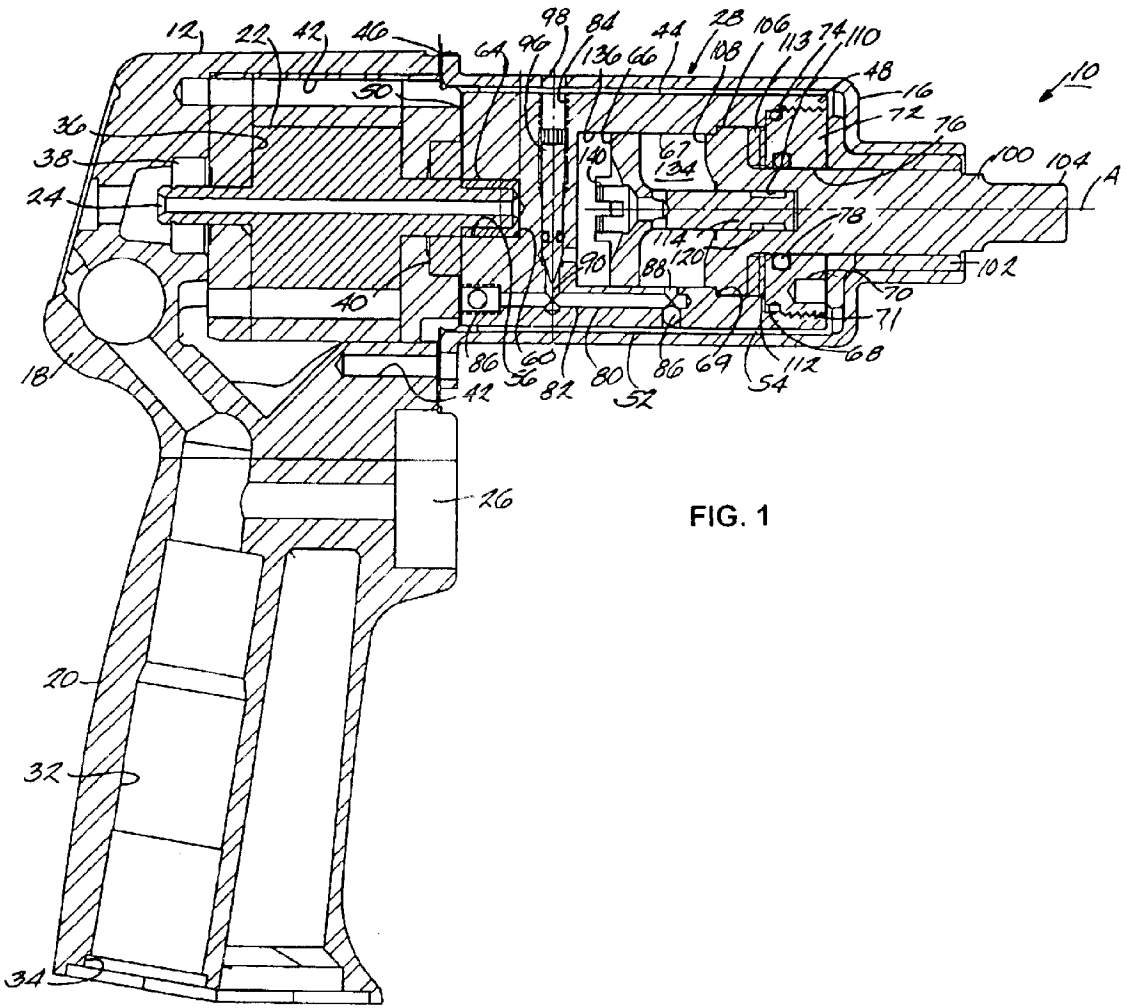
FIG. 1 is a side view, partially in section, of a rotary tool embodying the present invention.

FIG. 1 illustrates a rotary tool 10, such as, for example, an impact wrench embodying aspects of the present invention. The rotary tool 10 includes a housing 12 having a forward portion 16 and a rearward portion 18, an operator's grip or handle 20, a motor 22 (e.g., an air motor) having a motor shaft 24, a trigger 26 operably coupled to the motor 22 to control motor speed, and a rotary drive system 28. The motor shaft 24 defines a central axis A, which extends axially through the rotary tool 10.

The handle 20 includes an air channel 32 having an inlet 34. In some constructions (not shown), the air channel 32 includes seals (e.g., O-rings, washers, etc.), filters (e.g., air strainers), and valves (e.g., spring-operated valves) for controlling air quality into and airflow through the rotary tool 10. Additionally, in some constructions (not shown), the air channel 32 includes a throttle valve (not shown) that is operably connected to the trigger 26 for controlling the flow of air through the air channel 32, the operating speed of the rotary tool 10, and/or the torque generated by the rotary tool 10. Also, in rotary tools 10 having forward and reverse modes, a reverse valve (not shown) may be positioned along the air channel 32 to direct air flow through the motor 22 in either of two directions (i.e., forward and reverse).

The rearward portion 18 of the housing 12 defines a cavity 36 surrounding the motor 22. The motor shaft 24 extends through the cavity 36 along the central axis A and is supported by bearings 38, 40 for rotation relative to the housing 12. Pressurized air from the air channel 32 enters the rearward end of the cavity 36 and travels across the motor 22, causing the motor 22 to rotate about the central axis A in a conventional manner. In some constructions, the cavity 36 is sealed (e.g., the cavity includes O-rings, washers, valves, etc.) to prevent unintended air exchange with the atmosphere. One having ordinary skill in the art will appreciate that while one type of air motor has been described herein and is shown in the figures, other types of air motors (not shown) could also or alternately be used. In other constructions (not shown), electric motors (not shown) could also or alternately be used.

Fasteners (not shown) extend through the forward portion 16 of the housing 12 and into bores 42 located in the rearward portion 18 of the housing 12, coupling the forward and rearward portions 16, 18 of the housing 12. A seal (e.g., an O-ring, a washer, etc.) 46 is arranged between the forward and rearward portions 16, 18 to prevent airflow into or out of the housing 12 between the forward and rearward portions 16, 18.

With reference to FIGS. 1, 2A, 2B, 3, 5, and 8A–8D, the rotary drive system 28 includes a flywheel or frame 44 supported in the forward portion 16 of the housing 12 for rotation about the central axis A. The frame 44 is a substantially cylindrical member having a forward surface 48, a rearward surface 50 substantially parallel to the forward surface 48, and a circumferential wall 52 extending therebetween. Together, the circumferential wall 52 and the interior surface of the forward portion 16 of the housing define a space 54, which accommodates rotational movement of the frame 44 relative to the forward portion 16 of the housing 12.

With reference to FIG. 1, the rearward face 50 defines a recess 56 having a number of splines 60 extending radially into the recess 56. A forward end of the motor shaft 24 includes splines 64, which matingly engage corresponding splines 60, operably coupling the frame 44 and the motor shaft 24 for concurrent rotation about the central axis A in either a forward (e.g., clockwise) or rearward (e.g., counterclockwise direction).

Figure 2A:
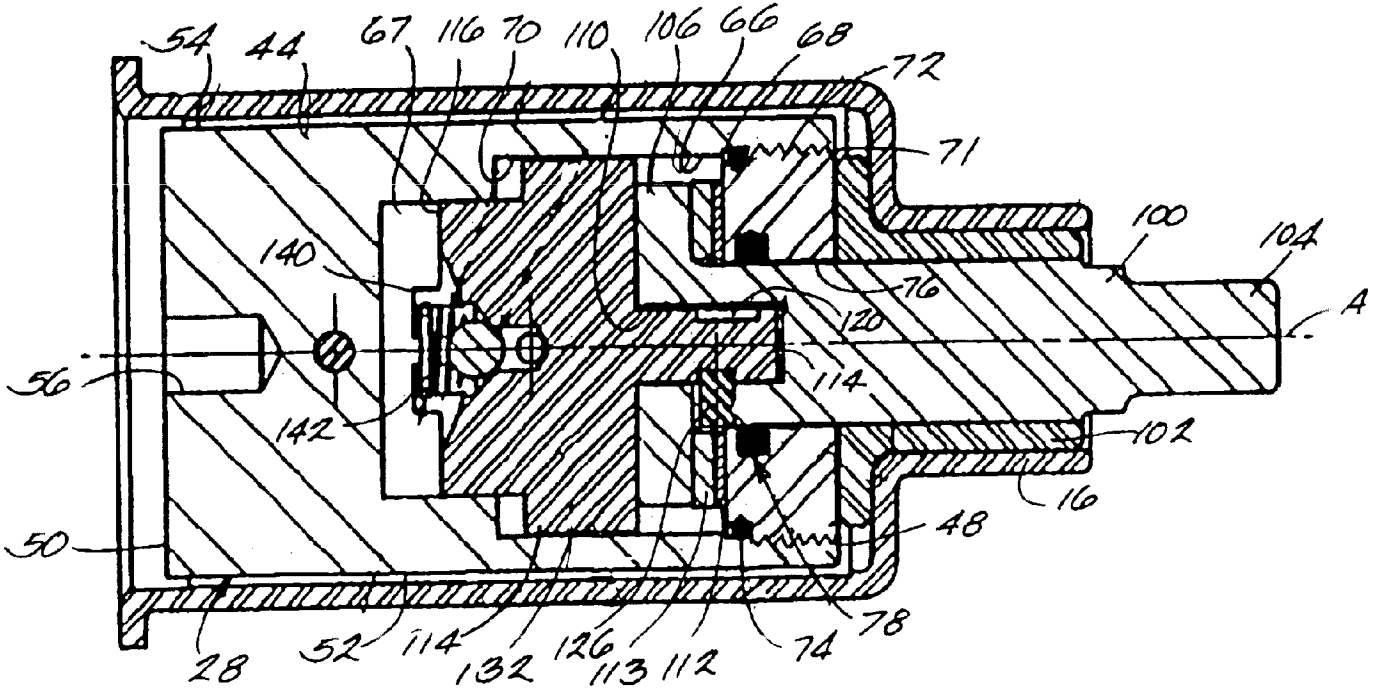
FIGS. 2A and 2B are side views, partially in section, of a portion of a rotary drive system of the rotary tool shown in FIG. 1.
Figure 2B:
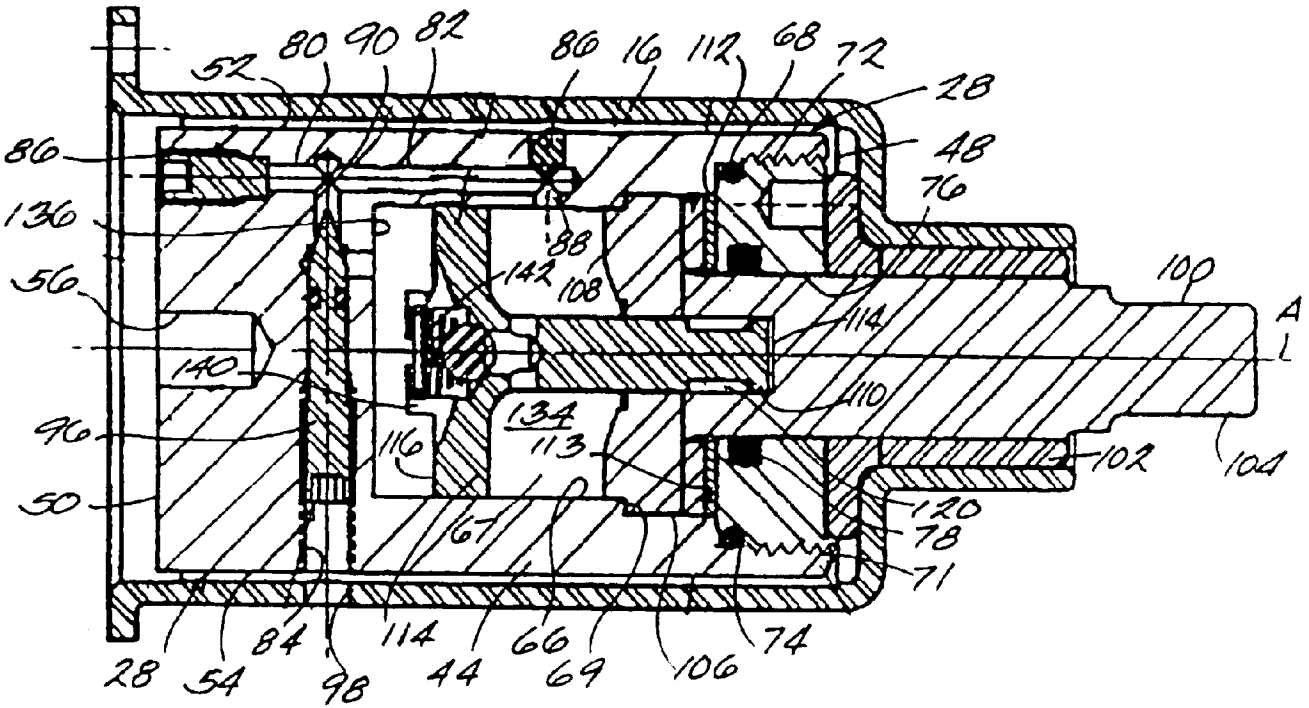
Figure 3:
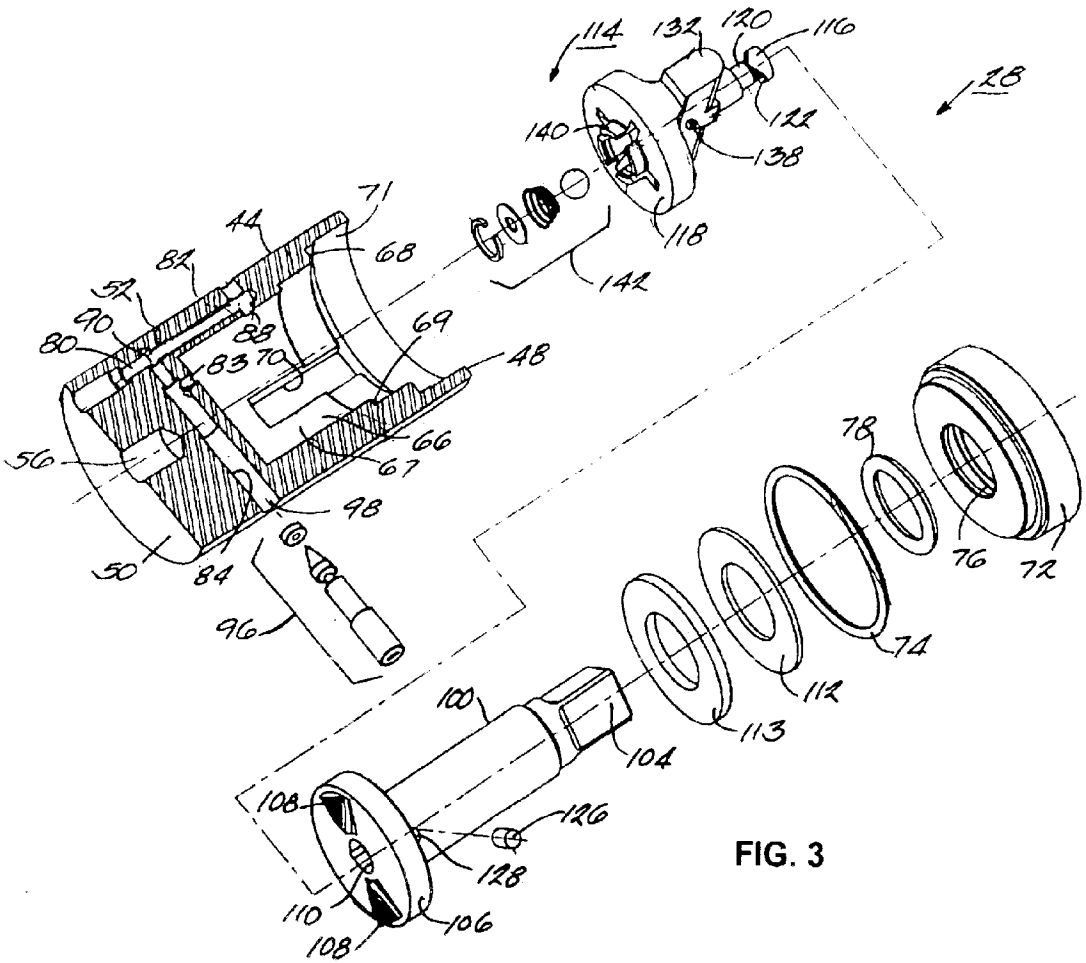
FIG. 3 is an exploded view, partially in section, of the portion of the rotary drive system shown in FIGS. 2A and 2B.
Figure 5:
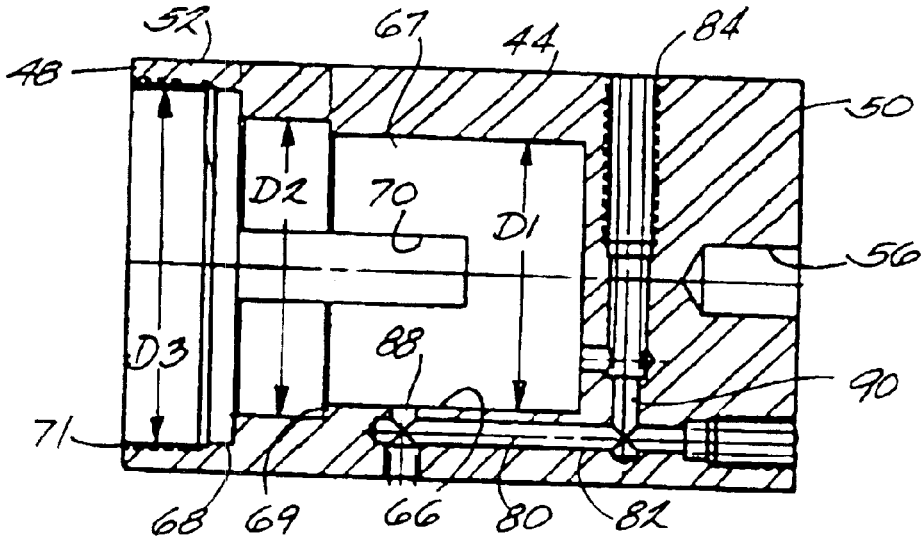
FIG. 5 is a side view, partially in section, of a frame of the rotary drive system shown in FIGS. 2A and 2B.
Figure 4:
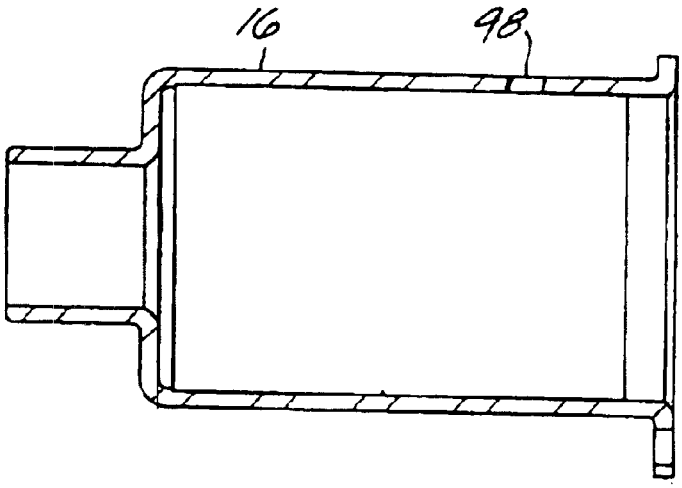
FIG. 4 is a side view, partially in section, of a housing of the rotary drive system shown in FIGS. 2A and 2B.

As shown in FIGS. 1, 2A, 2B, 3, 5, and 8A–8D, the forward and rearward surfaces 48, 50 of the frame 44 define an internal space 67 housing a quantity of lubricant (not shown). The interior surface 66 of the circumferential wall 52 includes first and second shoulders 68, 69 that extend radially into the internal space 67. As shown in FIG. 5, the area of the internal space 67 rearward the second shoulder 69 has a first diameter D1, the area between the first and second shoulders 68, 69 has a second diameter D2, and the area forward the second shoulder 69 has a third diameter D3. As shown in FIGS. 2A, 3, and 5, axial grooves 70 extend into the circumferntial surface 52 between the first and second shoulders 68, 69. In some constructions, the frame 44 includes two axial grooves 70 spaced approximately 180 degrees apart. In other constructions (not shown), the frame 44 may include one, three, or more axial grooves 70 and the axial grooves 70 can be arranged in any of a number of configurations and orientations.

The forward surface 48 defines a forward opening 71 communicating with the interior space 67. A cover 72 is coupled to (e.g., threaded into, clamped onto, or otherwise fastened to) the forward surface 48 to seal the internal space 67. In the illustrated construction, the cover 72 is threaded into forward surface 48 and a seal 74 (e.g., an O-ring, a washer, etc.) is clamped between the second shoulder 69 and the cover 72 to prevent fluid exchange between the internal space 67 and the space 54. The cover 72 also defines an internal opening 76 opening along the central axis A and including a seal 78.

A bleed line 80 extends through the frame 44 for conveying lubricant from one portion of the internal space 67 to another portion of the internal space 67 (as described below). In the illustrated construction (see FIGS. 2A, 3, and 5), the bleed line 80 includes an axial channel 82 extending axially through the frame 44, and a radial channel 84 that extends radially through the frame 44 and intersects the axial channel 82. As shown in FIG. 2B, plugs 86 (e.g., a ball bearing, a threaded plug, etc.) seal two ends of the axial channel 82. A first opening 88 of the axial channel 82 communicates with the internal space 67 and a second opening 90 of the axial channel 82 intersects an end of the radial channel 84. An opening 83 of the radial channel 84 communicates with the internal space 67. A valve (e.g., a needle valve) 96 is positioned in the radial channel 84 and is operable to selectively restrict and/or prevent fluid flow through the bleed line 80 (as explained in greater detail below). An operator and/or the manufacturer can increase or decrease fluid flow through the bleed line 80 by inserting a tool (e.g., a screwdriver, a wrench, etc.) through an opening 98 (shown in FIGS. 1, 2B, 3, and 4) in the forward portion 16 of the housing 12 to adjust the position of the valve 96.

As shown in FIGS. 1, 2A, 2B, and 8A–8D, an output shaft or anvil 100 extends through the cover 72 and is supported in the forward portion 16 of the housing 12 by bushing 102 for rotation about the central axis A. However, in other constructions (not shown), other support structure, such, as for example, bearings can also or alternately support the output shaft 100. Additionally, in other constructions (not shown) the output shaft 100 can be arranged to rotate about a second axis that is substantially parallel, or alternatively, at an angle relative to the central axis A.

With reference to FIGS. 1, 2A, 2B, 3, 7A, 7B, 7D, and 8A–8D, the output shaft 100 is substantially cylindrical and includes a forward or tool engaging end 104 that is adapted to support a fastener (e.g., a bolt, a screw, a nut, etc.) and/or a fastener engaging element (e.g., a socket). A base portion 106 of the output shaft 100 extends into the internal space 67 and includes two rearwardly extending cams 108. In other constructions (not shown), the base portion 106 can include one, three, or more cams 108. As shown in FIGS. 1 and 2B, the base portion 106 rests against the second shoulder 69. Additionally, in some constructions, the diameter of the base portion 106 is substantially similar to the second diameter D2 and the base portion 106 closely engages the circumferential wall 52 to prevent lubricant from leaking between the second shoulder 69 and the base portion 106. The base portion 106 also defines an aperture 110 that extends axially into the output shaft 100 along the central axis A.

As shown in FIGS. 1, 2A, 2B, and 3, in some constructions, seals 112 (washers, O-rings, etc.) are positioned between the cover 72, the base portion 106 and/or the circumferntial surface 52 to prevent lubricant from exiting the internal space 67 via the forward opening 71. Additionally, in some constructions, friction-reducing members 113 (e.g., bearings, low-friction washers, etc.) are positioned between the cover 72 and the base portion 106.

Figure 6D:
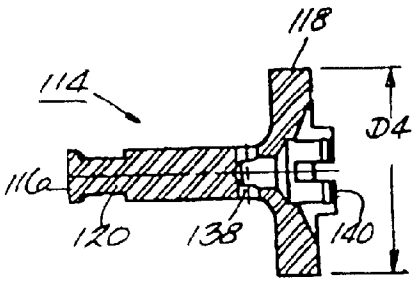
FIGS. 6A–6D illustrate a piston of the rotary drive system shown in FIGS. 2A and 2B.
Figure 6B:
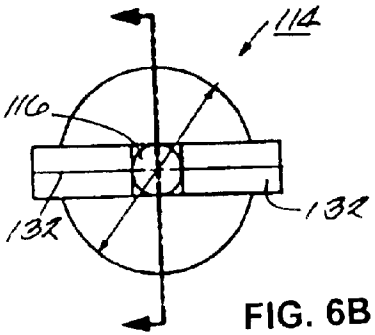
Figure 6A:
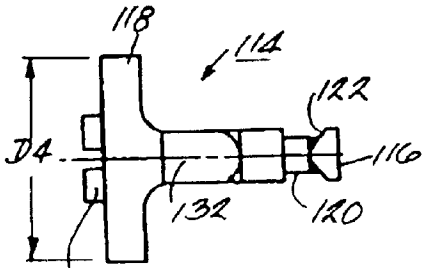
Figure 6C:
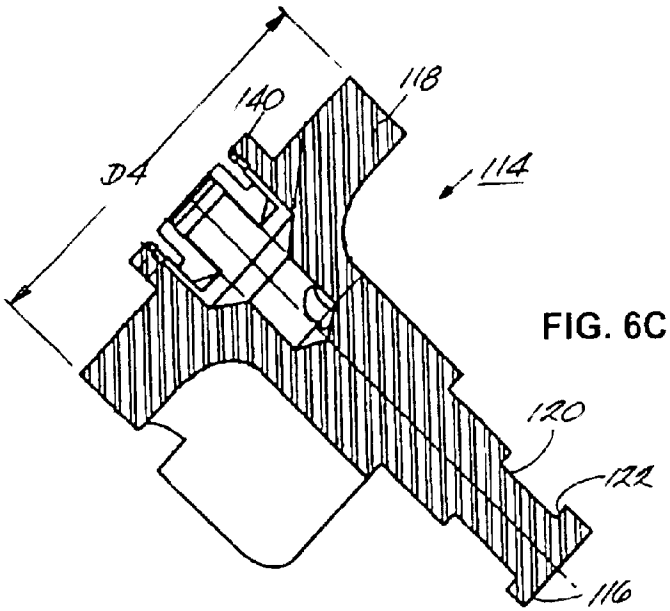
Figure 7B:
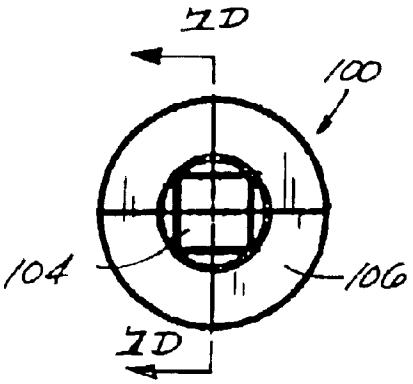
FIGS. 7A–7D illustrate an output shaft of the rotary drive system shown in FIGS. 2A and 2B.
Figure 7A:
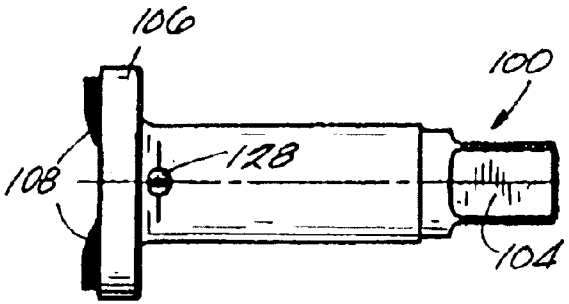
Figure 7C:
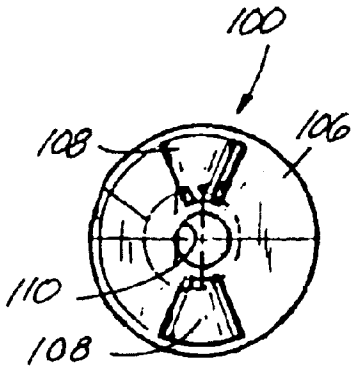
Figure 7D:
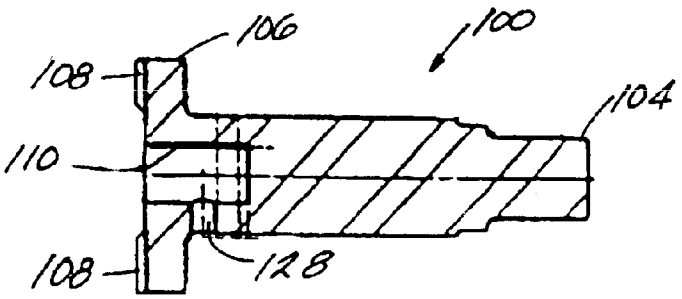

A piston (shown in FIGS. 1, 2A, 2B, 3, 6A–6D, and 8A–8D) 114 includes a first end 116 and a second end 118 and is supported in the internal space 67 for rotational movement with the frame 44 about the central axis A and for reciprocating movement relative to the frame 44 along the central axis A. The first end 116 of the piston 114 is substantially cylindrical and is rotatably received in the aperture 110 at the base 106 of the output shaft 100. A notch 120 extends circumferentially around the first end 116. As shown in FIGS. 3, 6A, and 6B, a forward end 122 of the notch 120 is contoured and includes a protrusion 147. A fastener (e.g., a set screw, a key, a snap ring, etc.) and/or a radially extending protrusion 126 extends through an opening 128 (shown in FIG. 3) in the output shaft 100 and engages the notch 120 on the first end 116 of the piston 114 to slidably and rotatably couple the output shaft 100 and the piston 114. Together, the notch 120 and the fastener 126 limit axial movement of the piston 114 along the output shaft 100. More particularly, the piston 114 is moveable along the central axis A between a fully retracted position (shown in FIGS. 8A and 9A) and a fully extended position (shown in FIGS. 8B and 9B) and the distance between the fully retracted and fully extend positions is approximately equal to the axial length of the notch 120. Additionally, the mating engagement of the fastener 126 and the notch 120 facilitate relative rotational motion between the piston 114 and the output shaft 100.

The second end 118 of the piston 114 is substantially cylindrical and has a diameter D4 (see FIGS. 6A, 6C, and 6D), which is substantially similar to the first diameter D1. More specifically, the second end 118 closely engages the circumferential wall 52, preventing or reducing the flow of lubricant between the circumferential wall 52 and the second end 118 of the piston 114.

As shown in FIGS. 2A, 3, 6A, 6D, 8A–8D and 9A–9D, arms 132 (two arms 132 are shown) extend radially from the piston 114 between the first and second ends 116, 118. In other constructions (not shown), the piston 114 can include one, three, or more arms 132. The arms 132 engage axial grooves 70, facilitating the transfer of rotational motion from the frame 44 to the piston 114. Additionally, as described below, the arms 132 are moveable along the axial grooves 70 to facilitate axial movement of the piston 114 relative to the frame 44. The mating engagement between the arms 132 and the axial groves 70 also prevents the piston 114 from pivoting about the central axis A relative to the frame 44.

As shown in FIGS. 1 and 8A–8D, the second end 118 of the piston 114 divides the internal space 67 into a first or forward chamber 134 and a second or rearward chamber 136. Lubricant is moveable between the first and second chambers 134, 136 along the bleed line 80, or alternatively, along a channel 138 (see FIG. 6D). As shown in FIGS. 3 and 6D, channel 138 extends axially through the second end 118 of the piston 114 and radially outwardly through a central portion of the piston 114 between the arms 132, fluidly connecting the first and second chambers 134, 136.

As shown in FIGS. 1, 2B, and 3, valve 96 is positioned along the bleed line 80 to control the flow of lubricant between the first and second chambers 134, 136. As shown in FIGS. 1, 2A, 2B, 3, 6A–6D, and 8A–8D, feet 140 extend axially from the second end 118 of the piston 114 and support valve 142. As explained in greater detail below, valve 142 is operable to control the flow of lubricant along channel 138. In the illustrated construction, valve 142 is a ball valve. However, in other constructions (not shown), other known valves can also or alternatively be used to control the flow of lubricant through channel 138.

During operation of the rotary tool 10, the tool engaging end 104 (or a fastener engaging element coupled to the tool engaging end 104) is positioned to matingly engage a fastener (e.g., a nut, a bolt, a screw, etc.). To tighten the fastener or thread the fastener into a work piece (not shown), the rotary tool 10 is operated in a forward mode and to loosen the fastener or unthread the fastener from the work piece, the rotary tool 10 is operated in a reverse mode. FIGS. 8A–8D and 9A–9D and the following description refer to operation of the rotary tool 10 in the forward mode. However, one having ordinary skill in the art will appreciate that the rotary tool 10 of the present invention can also or alternately be operated in a reverse mode and that operation of the rotary tool 10 in the reverse mode is substantially similar to operation of the rotary tool 10 in the forward mode.

To initiate operation of the rotary tool 10, an operator depresses the trigger 26, causing power in the form of compressed air or electricity to energize the motor 22 and to rotate the motor shaft 24 in a forward direction (represented by arrow 146 in FIGS. 8A–8D and 9A–9D) about the central axis A. The motor shaft 24 transfers rotational motion to the rotary drive system 28 via the mating engagement of splines 60, 64.

Figure 8A:
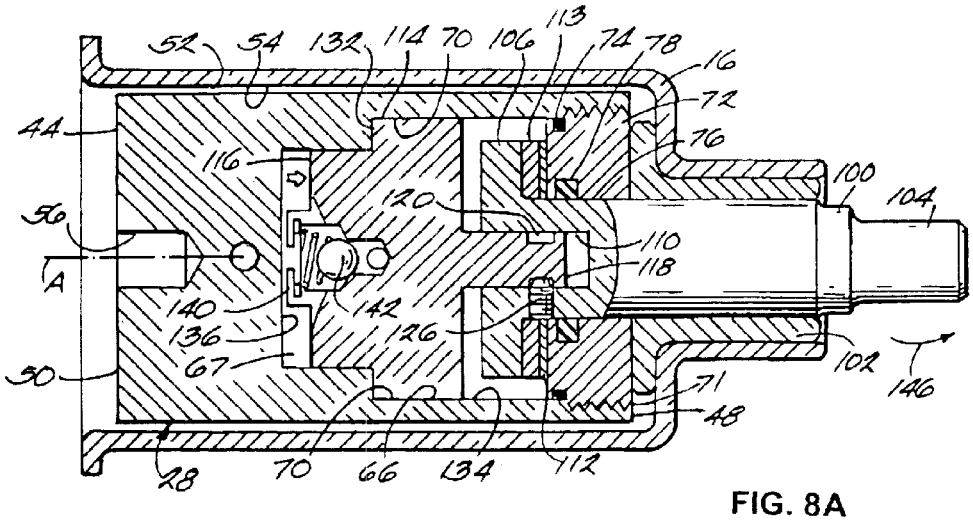
FIGS. 8A–8D are side views of the portion of the rotary drive system shown in FIGS. 2A and 2B operating in a forward mode.
Figure 9A:
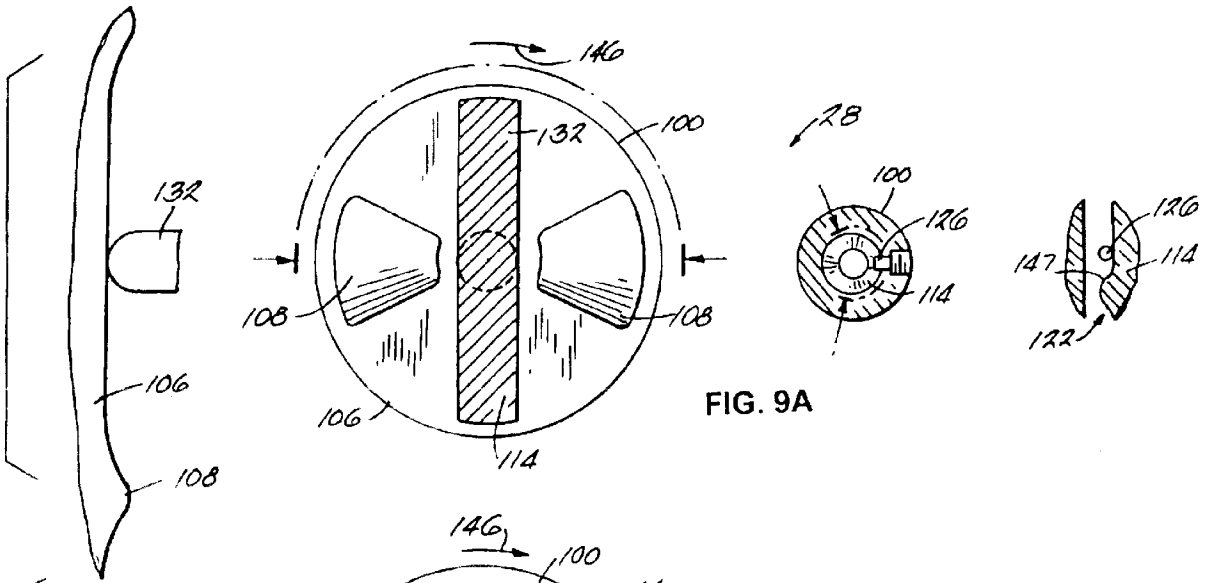
FIGS. 9A–9D are sectional views of the portion of the rotary drive system shown in FIGS. 2A and 2B operating in a forward mode.

With reference first to FIGS. 8A and 9A, the piston 114 is in a fully retracted position (i.e., the piston 114 is in a rearward-most position in the internal space 67), and the fastener 126 engages a rearward-most position in the notch 120. Additionally, the valve 142 is in a closed position, preventing lubricant from moving through the channel 138 between the forward and rearward chambers 134, 136. Also, when the piston 114 is in the fully retracted position, the pressure of the lubricant in the forward and rearward chambers 134, 136 is approximately equal.

Figure 8B:
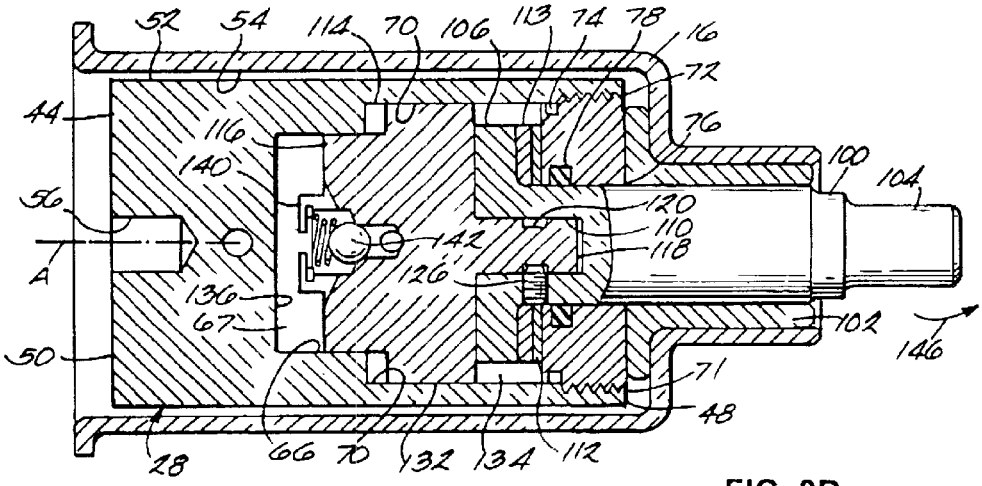
Figure 9B:
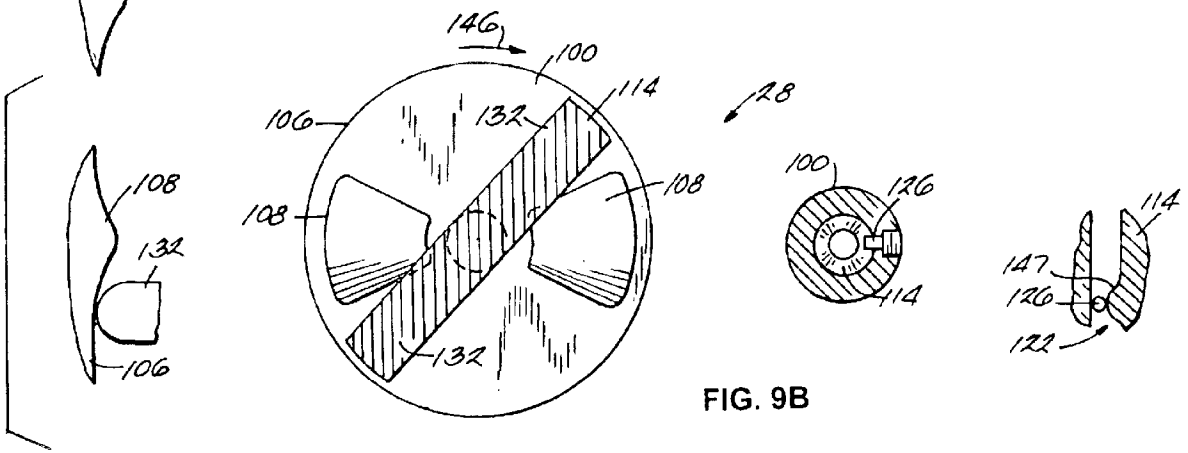

With reference to FIGS. 8B and 9B, as the motor 22 begins to rotate the frame 44 about the central axis A, the frame 44 transfers rotational motion to the piston 114 via the mating engagement between the arms 132 and the grooves 70. The notch 120 on the first end 116 of the piston 114 travels along the fastener 126 as the piston 114 rotates about the central axis A. As the contoured end 122 of the notch 120 travels across the fastener 126, the fastener 126 pulls the piston 114 forward along the central axis A toward the base portion 106 of the output shaft 100. In this manner, the piston 114 simultaneously rotates about the central axis A in the forward direction 146 and moves forward along the central axis A toward the output shaft 100. As the piston 114 is pulled forward by the engagement between the fastener 126 and the contoured end 122 of the notch 120, valve 142 moves from a first or closed position to a second or open position. In particular, as the piston 114 is pulled forward, the pressure in the forward chamber 134 increases. The increased pressure in the forward chamber 134 forces the ball portion of valve 142 rearwardly with respect to the second end 118 of the piston 114, allowing lubricant to move through the channel 138 from the forward chamber 134 to the rearward chamber 136.

As the piston 114 continues to rotate about the central axis A, the fastener 126 rides along the contoured end 122, moving the piston 114 forward along the central axis A to a forward-most position (shown in FIGS. 8B and 9B). When the piston 114 is in the forward-most position, forward portions of the arms 132 contact the base 106 of the output shaft 100. In the illustrated construction, the contoured end 122 of the notch 120 includes protrusion 147. In this construction, each time the piston 114 rotates about the central axis A, the fastener 126 engages the protrusion 147 once. More particularly, each time that the piston 114 rotates about the central axis A, the engagement between the protrusion 147 and the fastener 126 causes the arms 132 to contact the cams 108. In other constructions (not shown), the notch 120 can have two, three, or more protrusions 147 for causing the arms 132 to contact the cams 108 two or more times each time the piston 114 rotates about the central axis A.

Figure 8C:
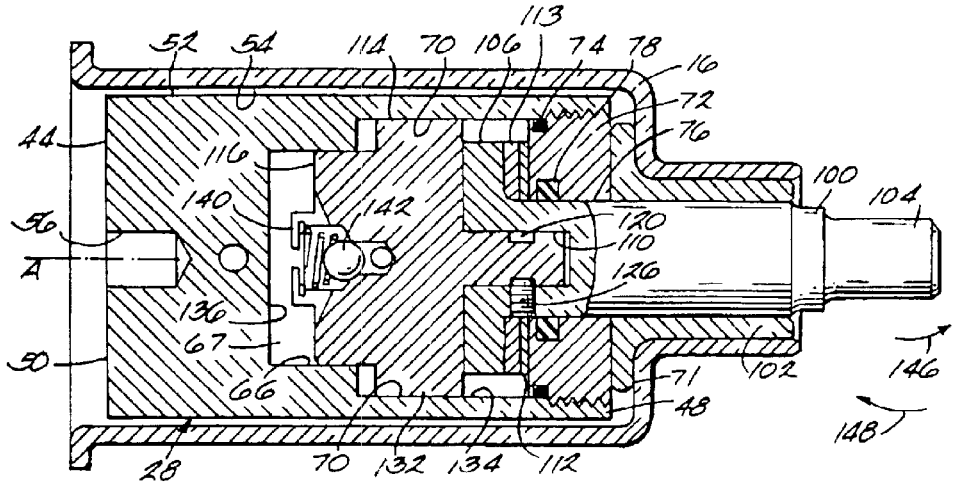
Figure 9C:
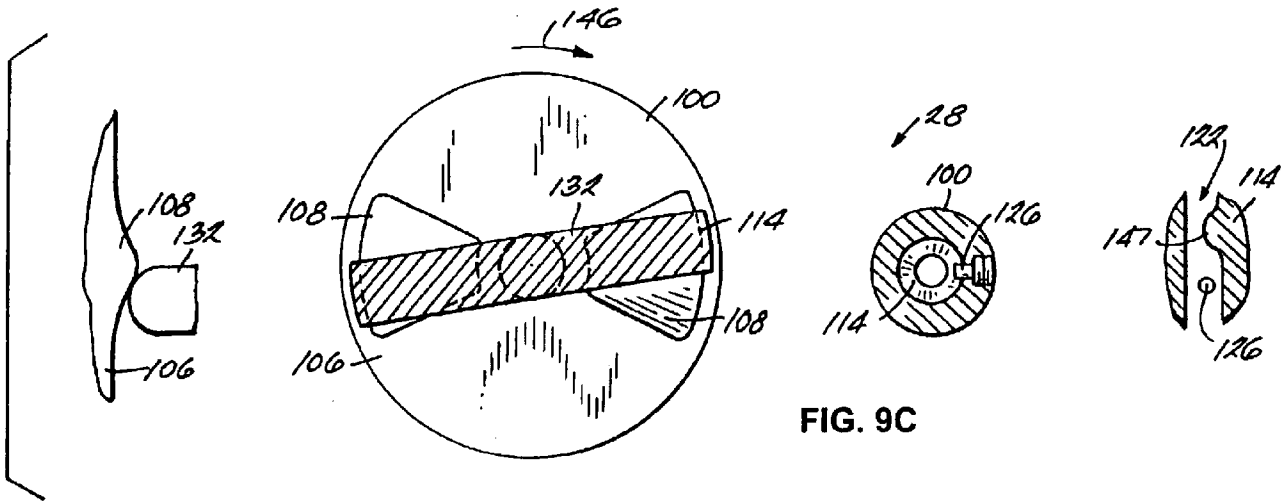

With reference to FIGS. 8C and 9C, as the piston 114 moves forward along and rotates about the central axis A, the arms 132 are rotated into engagement with the cams 108 on the base 106 of the output shaft 100. The impact between the arms 132 and the cams 108 transfers an impulse or force from the piston 114 to the output shaft 100, causing the output shaft 100 to rotate about the central axis A in the forward direction 146. The impact between the arms 132 and the cams 108 also causes the piston 114 to rebound a relatively short distance rearwardly along the central axis A and to rotate a relatively short distance about the central axis A in the reverse direction 148. The rearward motion of the piston 114 causes an increase in pressure in the rearward chamber 136. More particularly, in some constructions, the pressure in the rearward chamber 136 reaches between 1000 psi and 4000 psi (e.g., 3000 psi). After the initial impact, the forward rotation of the frame 44 about the central axis A, and in some cases, the increase in pressure in the rearward chamber 136, causes the arms 132 to remain in contact with the cams 108 to transfer rotational energy to the output shaft 100.

Figure 8D:
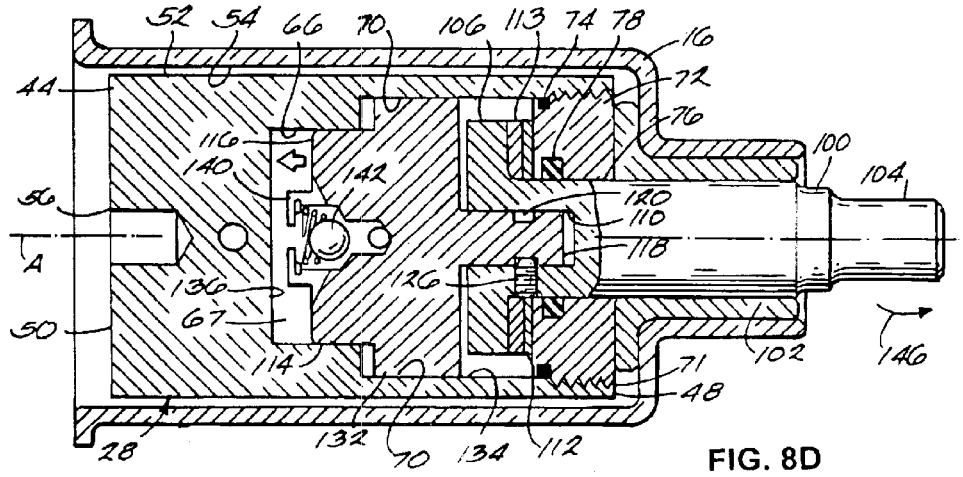
Figure 9D:
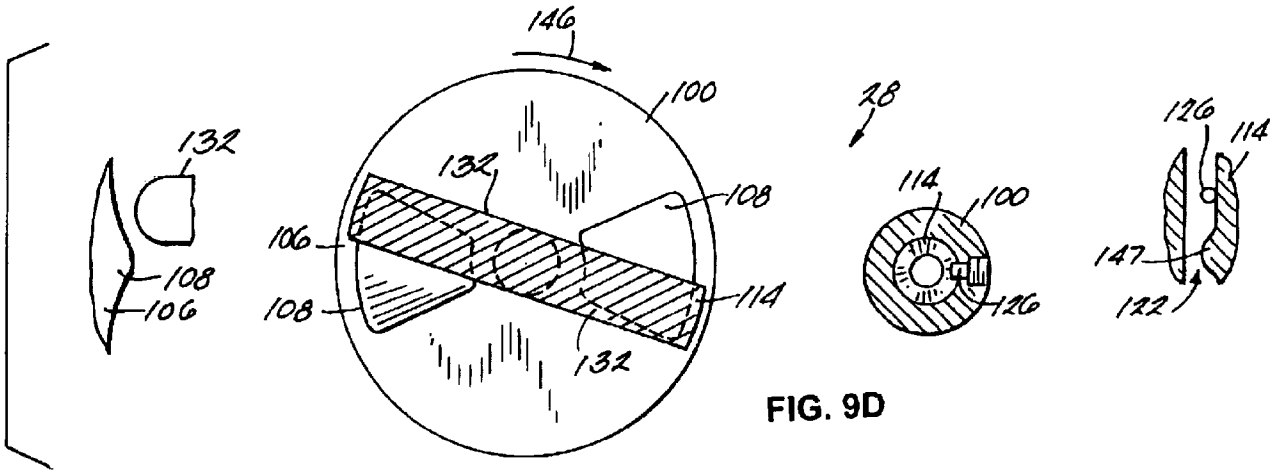

Additionally, after the impact between the cams 108 and the arms 132, the piston 114 begins to move rearwardly, disengaging the arms 132 from the cams 108. More particularly, as shown in FIGS. 8D and 9D, as the piston 114 moves rearwardly along the central axis A, the arms 132 are moved rearwardly away from the cams 108 so that the arms 132 pass the second side of the cams 108 without contacting the cams 108.

As the piston 114 continues to rotate about the central axis A, the pressure difference between the forward and rearward chambers 134, 136 forces lubricant from the rearward chamber 136, through bleed line 80, past valve 96, and into the forward chamber 134. In this manner, the pressure in the rearward chamber 136 is reduced, allowing the piston 114 to move axially to the rearward-most position. Lubricant continues to move along the bleed line 80 from the rearward chamber 136 to the forward chamber 134 until the pressure of the forward and rearward chambers 134, 136 is approximately equal. In the illustrated construction, the pressure in the forward and rearward chambers 134, 136 is approximately equal when the arms 132 pass across the cams 108.

Once the piston 114 returns to the rearward-most position, the piston 114 continues to rotate with the frame 44 about the central axis A until the engagement between the notch 120 and the fastener 126 causes the piston 114 to move forwardly along the central axis A. In the illustrated construction, the piston 114 rotates approximately 200 degrees about the central axis A before the fastener 126 engages the protrusion 147 to re-initiate forward motion of the piston 114. However, as explained above, in other constructions (not shown), the notch 120 can include two, three, or more protrusions 147. In these constructions, the piston 114 can rotate less than 200 degrees before the mating engagement between the fastener 126 and one of the protrusions 147 causes the piston 114 to move forwardly along the central axis A.

The constructions described above and illustrated in the drawings are presented by way of example only and are not intended as a limitation upon the concepts and principles of the present invention. As such, it will be appreciated by one having ordinary skill in the art, that various changes in the elements and their configuration and arrangement are possible without departing from the spirit and scope of the present invention as set forth in the appended claims.

For example, one having ordinary skill in the art will appreciate that the size and relative dimensions of the individual parts of the rotary tool can be changed significantly without departing from the spirit and scope of the present invention.

As such, the functions of the various elements and assemblies of the present invention can be changed to a significant degree without departing from the spirit and scope of the present invention.

What is claimed is:

1. A method of operating a rotary tool, the rotary tool including a housing having a forward end and supporting a motor, the motor having a motor shaft extending through the housing and defining an axis, a frame coupled to the motor shaft and being rotatable relative to the housing about the axis in response to rotation of the motor shaft, the frame defining an internal space, a piston supported in the internal space for rotational movement with the frame about the axis and for axial movement relative to the frame along the axis, and an output shaft supported in the forward end of the housing and being rotatable about the axis, the method comprising:

engaging a fastener with the output shaft;

rotating the housing about the axis with the motor shaft;

transferring rotational motion from the housing to the piston;

reciprocating the piston in the housing along the axis;

cammingly engaging the output shaft with the piston; and transferring rotational motion from the piston to the output shaft.

2. The method of claim 2, wherein the housing encloses lubricant, wherein the piston and the housing define an area of high pressure and an area of low pressure, and wherein reciprocating the piston in the housing along the axis includes driving the piston from the area of high pressure toward the area of low pressure.

3. The method of claim 2, wherein the housing includes a bleed line communicating between the area of high pressure and the area of low pressure, the method further comprising moving lubricant along the bleed line between the high pressure area and the low pressure area.

4. The method of claim 2, wherein the piston defines a channel extending between the area of high pressure and the area of low pressure, and wherein the piston supports a valve positioned along the channel, and the method further comprising controlling the flow of lubricant along the channel between the area of high pressure and the area of low pressure with the valve.

5. A rotary tool comprising:

a housing having a forward end and supporting a motor, the motor having a motor shaft extending axially through the housing and defining an axis;

a frame coupled to the motor shaft and being rotatable relative to the housing about the axis in response to rotation of the motor shaft, the frame defining an interior space;

a piston supported by the frame and being moveable axially in the interior space; and an output shaft supported in the forward end of the housing and being rotatable about the axis, the output shaft having a plurality of cams, the piston being engageable with the plurality of cams to intermittently hammer the output shaft;

wherein the frame houses lubricant, and wherein axial movement of the piston creates an area of high pressure in the frame and an area of low pressure in the frame.

6. The rotary tool of claim 5, wherein the housing includes a bleed line communicating between the area of high pressure and the area of low pressure.

7. A rotary tool comprising:

a housing having a forward end and supporting a motor, the motor having a motor shaft extending axially through the housing and defining an axis;

a frame coupled to the motor shaft and being rotatable relative to the housing about the axis in response to rotation of the motor shaft, the frame defining an interior space;

a piston supported by the frame and being moveable axially in the interior space; and an output shaft supported in the forward end of the housing and being rotatable about the axis, the output shaft having a plurality of cams, the piston being engageable with the plurality of cams to intermittently hammer the output shaft;

wherein the frame houses lubricant, and wherein the piston and the frame define an area of high pressure and an area of low pressure, the piston includes a channel, the channel communicating between the area of high pressure and the area of low pressure.

8. The rotary tool of claim 7, further comprising a cheek valve positioned along the channel to control the flow of lubricant along the channel between the area of high pressure and the area of low pressure.

9. A rotary tool comprising:

a housing having a forward end and supporting a motor, the motor having a motor shaft extending axially through the housing and defining an axis;

a frame coupled to the motor shaft and being rotatable relative to the housing about the axis in response to rotation of the motor shaft, the frame defining an internal space;

a piston supported in the internal space for rotation with the frame about the axis; and an output shaft supported in the forward end of the housing and being rotatable about the axis, one of the output shaft and the piston having a protrusion, an other of the output shaft and the piston having a contoured recess, the protrusion being engageable in the recess to rotatably couple the output shaft and the piston, the protrusion cammingly engaging the contoured recess to reciprocate the piston along the axis.

10. The rotary tool of claim 9, wherein the output shaft includes a rearward surface having a plurality of axially extending cams, and wherein the piston is cammingly engageable with the plurality of cams to intermittently hammer the output shaft about the axis.

11. The rotary tool of claim 9, wherein the frame defines an axially extending groove, and wherein the piston includes a plurality of radially extending arms, at least one of the plurality of arms being engageable in the axially extending groove to transfer rotational motion from the frame to the piston.

12. The rotary tool of claim 9, wherein the frame houses lubricant, and wherein axial movement of the piston creates an area of high pressure in the frame and an area of low pressure in the frame to drive the piston along the axis.

13. A rotary tool comprising:

a housing having a forward end and supporting a motor, the motor having a motor shaft extending axially through the housing and defining an axis;

a frame coupled to the motor shaft and being rotatable relative to the housing about the axis in response to rotation of the motor shaft, the frame defining an interior space;

a piston supported by the frame and being moveable axially in the interior space; and an output shaft supported in the forward end of the housing and being rotatable about the axis, the output shaft having a plurality of cams, the piston being engageable with the plurality of cams to intermittently hammer the output shaft;

wherein the piston includes an axially extending portion, and wherein the output shaft defines an aperture, the axially extending portion being receiveable in the aperture;

wherein one of the axially extending portion and the output shaft includes a recess and an other of the axially extending portion and the output shaft includes a protrusion, the protrusion engaging the recess and limiting axial movement of the piston relative to the output shaft.

14. The rotary tool of claim 13, wherein the output shaft includes a second protrusion extending into the recess, and wherein the first protrusion selectively engages the second protrusion causing the piston to reciprocate along the axis between a forward position, in which the piston is cammingly engageable with the plurality of cams, and a rearward position, in which at least a portion of the piston is spaced a distance from a rearward surface of the output shaft.

15. A rotary tool comprising:

a housing having a forward end and supporting a motor, the motor having a motor shaft extending axially through the housing and defining an axis;

a frame coupled to the motor shaft and being rotatable relative to the housing about the axis in response to rotation of the motor shaft, the frame defining an interior space;

a piston supported by the frame and being moveable axially in the interior space; and an output shaft supported in the forward end of the housing and being rotatable about the axis, the output shaft having a plurality of cams, the piston being engageable with the plurality of cams to intermittently hammer the output shaft;

wherein the frame defines an axially extending groove, and wherein the piston includes a plurality of radially extending arms, at least one of the plurality of radially extending arms being engageable in the axially extending groove to transfer rotational motion from the frame to the piston;

wherein the output shaft includes a rearward surface, and wherein the plurality of cams extend axially from the rearward surface, the arms being cammingly engageable with the plurality of cams to intermittently hammer the output shaft.

16. A rotary tool comprising:

a housing having a forward end and supporting a motor, the motor having a motor shaft extending axially through the housing and defining an axis;

a frame coupled to the motor shaft and being rotatable relative to the housing about the axis in response to rotation of the motor shaft, the frame having a first end and a second end and defining an interior space between the first end and the second end;

a piston supported in the frame and being moveable axially in the interior space between a retracted position, in which the piston is adjacent the second end, and an extended position, in which the piston is spaced a distance from the second end; and an output shaft supported in the forward end of the housing and rotatable about the axis, the piston being engageable with the output shaft to hammer the output shaft about the axis when the piston is in the extended position;

wherein the frame houses lubricant, and wherein axial movement of the piston between the retracted position and the extended position creates an area of high pressure in the frame and an area of low pressure in the frame.

17. The rotary tool of claim 16, wherein the housing includes a bleed line communicating between the area of high pressure and the area of low pressure.

18. A rotary tool comprising:

a housing having a forward end and supporting a motor, the motor having a motor shaft extending axially through the housing and defining an axis;

a frame coupled to the motor shaft and being rotatable relative to the housing about the axis in response to rotation of the motor shaft, the frame having a first end and a second end and defining an interior space between the first end and the second end;

a piston supported in the frame and being moveable axially in the interior space between a retracted position, in which the piston is adjacent the second end, and an extended position, in which the piston is spaced a distance from the second end; and an output shaft supported in the forward end of the housing and rotatable about the axis, the piston being engageable with the output shaft to hammer the output shaft about the axis when the piston is in the extended position;

wherein the frame houses lubricant, and wherein the piston and the housing define an area of high pressure and an area of low pressure, the piston includes a channel communicating between the area of high pressure and the area of low pressure.

19. The rotary tool of claim 18, further comprising a check valve positioned along the channel to control the flow of lubricant along the channel between the area of high pressure and the area of low pressure.

* * * * *

UNITED STATES PATENT AND TRADEMARK OFFICE

CERTIFICATE OF CORRECTION

PATENT NO. : 6,863,134 B2
DATED : March 8, 2005
INVENTOR(S) : Warren A. Seith and Louis J. Calangelo III It is certified that error appears in the above-identified patent and that said Letters Patent is hereby corrected as shown below:

Column 8,
Line 52, "The method of claim 2" should be -- The method of claim 1 --.

Signed and Sealed this

Seventeenth Day of May, 2005

JON W. DUDAS
*Director of the United States Patent and Trademark Office*